US006622701B2

(12) United States Patent
Endo

(10) Patent No.: US 6,622,701 B2
(45) Date of Patent: Sep. 23, 2003

(54) ACCUMULATOR FUEL INJECTION SYSTEM DESIGNED TO AVOID FAILURE OF RELIEF VALVE CAUSED BY PRESSURE PULSATION

(75) Inventor: Hisashi Endo, Oobu (JP)

(73) Assignee: Denso Corporation, Kariya (JP)

( * ) Notice: Subject to any disclaimer, the term of this patent is extended or adjusted under 35 U.S.C. 154(b) by 11 days.

(21) Appl. No.: 09/994,046

(22) Filed: Nov. 27, 2001

(65) Prior Publication Data

US 2002/0062817 A1 May 30, 2002

(30) Foreign Application Priority Data

Nov. 27, 2000 (JP) ..... 2000-358774
Feb. 13, 2001 (JP) ..... 2001-034849

(51) Int. Cl.[7] ..... F02M 37/04
(52) U.S. Cl. ..... 123/467; 123/514
(58) Field of Search ..... 123/514, 467, 123/456; 137/512, 512.3; 138/26; 251/118

(56) References Cited

U.S. PATENT DOCUMENTS 4,392,507 A * 7/1983 Harris ..... 137/38
5,027,919 A * 7/1991 Silva et al. ..... 181/241
5,232,273 A * 8/1993 Eckstein et al. ..... 303/116.4
5,285,759 A * 2/1994 Terada et al. ..... 123/514
5,295,469 A * 3/1994 Kariya et al. ..... 123/456
5,975,061 A * 11/1999 Briggs et al. ..... 123/514
6,244,253 B1 * 6/2001 Haeberer et al. ..... 123/514

FOREIGN PATENT DOCUMENTS

JP 2-163458 6/1990
JP 4-72455 3/1992

* cited by examiner

*Primary Examiner*—Thomas N. Moulis
(74) *Attorney, Agent, or Firm*—Nixon & Vanderhye P.C.

(57) ABSTRACT

An accumulator fuel injection apparatus is provided which may be employed in a common rail system for diesel engines. The fuel injection apparatus includes a pressure relief valve designed to relieve an unwanted rise in pressure of the fuel within an accumulator. The pressure relief valve includes a pressure pulsation minimizing mechanism designed to minimize pressure pulsations which are generated in a drain line and propagated to a valve mechanism of the pressure relief valve, causing a valve-opening pressure of the pressure relief valve to change. The pressure pulsation minimizing mechanism may be implemented by an orifice or a check valve.

11 Claims, 5 Drawing Sheets

ACCUMULATOR FUEL INJECTION SYSTEM DESIGNED TO AVOID FAILURE OF RELIEF VALVE CAUSED BY PRESSURE PULSATION

BACKGROUND OF THE INVENTION

1. Technical Field of the Invention

The present invention relates generally to an accumulator fuel injection system for internal combustion engines, and more particularly to an improved structure of such a system designed to avoid a failure in operation of a pressure relief valve caused by pressure pulsations of a drain line.

2. Background Art

Accumulator fuel injection systems are known which supplies a high-pressure fuel to an accumulator of a common rail through a supply pump and distributes the fuel stored in the accumulator to a plurality of fuel injectors installed one in each cylinder of an internal combustion engine. The accumulator fuel injection systems usually have a pressure relief valve connected to the accumulator of the common rail. FIG. 7 shows an example of such a pressure relief valve.

The pressure relief valve 100 works as a pressure limiter and consists essentially of a valve 101, a cylindrical housing 102, and a hollow screw 103. The valve 101 is made up of a valve body having a valve hole 111 formed therein and a valve ball 105 selectively opening and closing the valve hole 111.

The housing 102 has an inlet side fuel hole 112, a small-diameter hole 113, and an outlet side fuel hole 114. Within the inlet side fuel hole 112, a spring guide 107 and a spring 108 are disposed which urge the valve ball 105 to close the valve hole 111 at all times. The hollow screw 103 has formed therein a longitudinal hole 115 communicating with the outlet side fuel hole 114 and a lateral hole 116 extending perpendicular to the longitudinal hole 115. The lateral hole 116 communicates with a fuel passage 117 in a low-pressure pipe 109 (i.e., a drain line) through which the fuel is returned back to a fuel tank (not shown).

A valve-opening pressure at which the ball valve 105 is to be opened is determined by a contact area between the valve body 104 and the valve ball 105 and a set load produced by the spring 108. The valve-opening pressure may be adjusted by changing the thickness of shims 118 and 119. The lateral hole 116 of the hollow screw 103 has a fuel-flowing sectional area substantially identical with that between the valve 101 and the longitudinal hole 115 of the hollow screw 103.

If some flow resistance exists in the low-pressure pipe 109, it may cause pressure pulsations of the fuel returned from the supply pump or the fuel injector back to the fuel tank through the low-pressure pipe to be transmitted to the valve 101 of the pressure relief valve 100, so that the valve ball 105 bounces within the valve body 104, thereby resulting in a change in valve-opening pressure of the pressure relief valve 100.

SUMMARY OF THE INVENTION

It is therefore a principal object of the invention to avoid the disadvantages of the prior art.

It is another object of the invention to provide an improved structure of an accumulator fuel injection system capable of avoiding a failure of a pressure relief valve caused by pressure pulsations occurring in a drain line.

According to one aspect of the invention, there is provided an accumulator fuel injection apparatus which may be employed in a common rail system for diesel engines. The accumulator fuel injection apparatus comprises: (a) a high-pressure supply pump pumping fuel out of a fuel tank, the high-pressure supply pump pressuring and discharging the fuel; (b) an accumulator storing therein the fuel discharged from the high-pressure supply pump; (c) a fuel injector injecting the fuel stored in the accumulator into an internal combustion engine; (d) a high-pressure fuel line extending from the high-pressure supply pump to the fuel injector through the accumulator; (e) a relief valve having an inlet communicating with the high-pressure fuel line, an outlet, and a valve mechanism disposed between the inlet and the outlet, the valve mechanism being responsive to a rise in pressure of the fuel within the high-pressure fuel line beyond a given level to establish communication between the inlet and the outlet for relieving the rise in pressure of the fuel within the high-pressure fuel line; and (f) a pressure pulsation absorbing mechanism disposed between the valve mechanism of the relief valve and a pressure pulsation source existing downstream of the outlet of the relief valve. The pressure pulsation absorbing mechanism works to absorb a pressure pulsation propagated from the pressure pulsation source to the valve mechanism of the relief valve, thereby avoiding an undesirable change in a valve-opening pressure at which the valve mechanism opens the inlet to drain the fuel within the accumulator.

In the preferred mode of the invention, the valve mechanism includes a valve body in which the inlet of the relief valve is formed and a valve member movable to open and close the inlet selectively. The relief valve includes a hollow cylindrical housing having a fuel hole formed between the inlet and the outlet. The pressure pulsation absorbing mechanism includes a hollow screw which is fitted in an open end of the housing as defining the outlet of the relief valve and has formed therein an orifice working to absorb the pressure pulsation to be propagated from the pressure pulsation source to the valve mechanism. A valve-urging mechanism is disposed in the fuel hole of the housing which urges the valve member to close the inlet constantly.

The hollow screw includes a sleeve and a flange head. The sleeve is retained within the open end of the housing and has formed therein a longitudinal chamber communicating with the fuel hole of the housing through an end of the sleeve. The flange head is formed on an end of the sleeve opposite the housing.

The orifice is implemented by a hole formed in the sleeve which extends perpendicular to the longitudinal chamber of the sleeve. The hole is smaller in diameter than the fuel hole of the housing and the longitudinal chamber of the sleeve.

The relief valve communicates at the inlet thereof with the accumulator for relieving a rise in pressure of the fuel within the accumulator beyond the given level to keep the pressure in the accumulator constant.

The relief valve may alternatively communicate at the inlet thereof with an outlet of the high-pressure supply pump for relieving a rise in pressure of the fuel flowing into the accumulator beyond the given level to keep the pressure of the fuel supplied to the accumulator constant.

The relief valve may alternatively communicate at the inlet thereof with a portion of the high-pressure fuel line extending from the accumulator to the fuel injector for relieving a rise in pressure of the fuel supplied to the fuel injector beyond the given level to keep the pressure of the fuel supplied to the fuel injector constant.

According to another aspect of the invention, there is provided an accumulator fuel injection apparatus which comprises: (a) a high-pressure supply pump pumping fuel out of a fuel tank, the high-pressure supply pump pressuring and discharging the fuel; (b) an accumulator storing therein the fuel discharged from the high-pressure supply pump; (c) a fuel injector injecting the fuel stored in the common rail into an internal combustion engine; (d) a high-pressure fuel line extending from the high-pressure supply pump to the fuel injector through the accumulator; (e) a relief valve having an inlet communicating with the high-pressure fuel line, an outlet, and a valve mechanism disposed between the inlet and the outlet, the valve mechanism being responsive to a rise in pressure of the fuel within the high-pressure fuel line beyond a given level to establish communication between the inlet and the outlet for relieving the rise in pressure of the fuel within the high-pressure fuel line; and (f) a check valve disposed between the valve mechanism of the relief valve and a pressure pulsation source existing downstream of the outlet of the relief valve. The check valve works to block transmission of a pressure pulsation from the pressure pulsation source to the valve mechanism of the relief valve.

In the preferred mode of the invention, the valve mechanism includes a valve body in which the inlet of the relief valve is formed and a valve member movable to open and close the inlet selectively. The relief valve includes a hollow cylindrical housing having a fuel hole formed between the inlet and the outlet. A hollow screw is provided which is fitted in an open end of the housing as defining the outlet of the relief valve and has disposed therein the check valve. A valve-urging mechanism is disposed in the fuel hole of the housing which urges the valve member to close the inlet constantly.

The check valve includes a valve body, a check valve member, and a check valve-urging mechanism. The valve body has an orifice formed downstream of the fuel hole of the housing of the relief valve in communication therewith. The check valve-urging mechanism urges the check valve member into constant engagement with the orifice of the valve body.

The relief valve communicates at the inlet thereof with the accumulator for relieving a rise in pressure of the fuel within the accumulator beyond the given level to keep the pressure in the accumulator constant.

The relief valve may alternatively communicate at the inlet thereof with an outlet of the high-pressure supply pump for relieving a rise in pressure of the fuel flowing into the accumulator beyond the given level to keep the pressure of the fuel supplied to the accumulator constant.

The relief valve may alternatively communicate at the inlet thereof with a portion of the high-pressure fuel line extending from the accumulator to the fuel injector for relieving a rise in pressure of the fuel supplied to the fuel injector beyond the given level to keep the pressure of the fuel supplied to the fuel injector constant.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
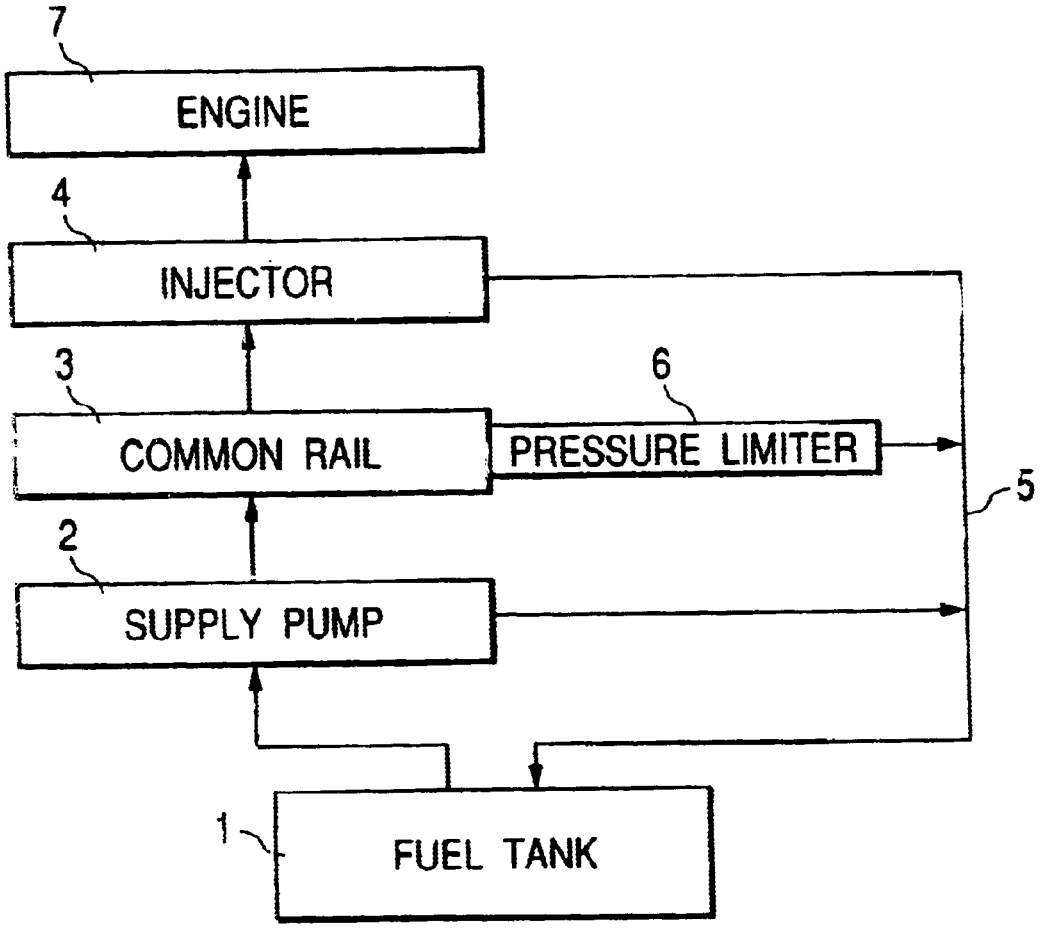
FIG. 1 is a block diagram which shows an accumulator fuel injection system according to the invention.

Referring to the drawings, wherein like reference numbers refer to like parts in several views, particularly to FIG. 1, there is shown an accumulator fuel injection system according to the first embodiment of the invention.

The shown system is also called a common rail system and consists of a supply pump 2, a common rail 3, and a plurality of fuel injectors 4 (only one is shown for the brevity of illustration) each of which is connected to one of output ports of the common rail 3. The supply pump 2 pumps fuel out of a fuel tank 1 and supplies the fuel to the common rail 3 at a given high pressure. The fuel stored in an accumulator provided in the common rail 3 is supplied to each of the fuel injectors 4. Each of the fuel injectors 4 injects the high-pressure fuel into one of cylinders of an internal combustion engine 7 such as a diesel engine.

The supply pump 2 has disposed therein a feed pump working as a low-pressure pump which is rotated in synchronism with rotation of a crankshaft of the engine 7 to pump the fuel out of the fuel tank 1. The supply pump 2 pressurizes the fuel pumped by the feed pump and supplies it to the common rail 3 through a fuel pipe. The supply pump 2 works to control the quantity of fuel to be sent to the common rail 3 to adjust the internal pressure of the accumulator in the common rail 3 (i.e., a common rail pressure).

The common rail 3 is one of surge tanks and designed to store therein the fuel under high pressure. The common rail 3, as described above, connects with each of the fuel injectors 4 through a fuel pipe. The fuel injectors 4 are installed in a cylinder block of the diesel engine 7, one for each cylinder, and supply a spray of fuel into combustion chambers at a high pressure. A pressure limiter 6 is installed in a low-pressure pipe 5 (i.e., a drain line) through which the fuel is returned from the supply pump 2, the common rail 3, and the fuel injectors 4 back to the fuel tank 1. The pressure limiter 6 works as a pressure relief valve which relieves a fuel pressure in the accumulator of the common rail 3 beyond a specified limit to keep it at all the time. In this embodiment, the pressure limiter 6 is disposed between the accumulator of the common rail 3 and a fuel passage 10 of the low-pressure pipe 5, but may alternatively be installed between the low-pressure pipe 5 and an outlet of the supply pump 2 to keep the fuel pressure to be supplied to the common rail 3 at a constant level.

Figure 3:
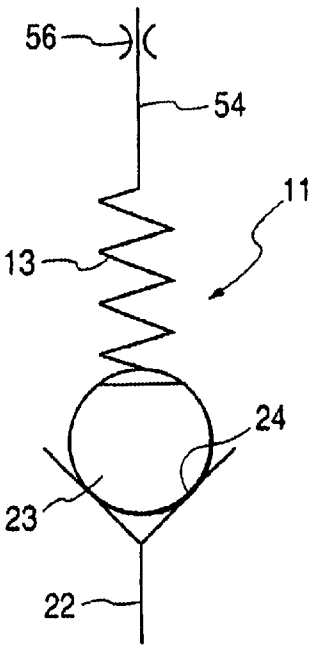
FIG. 3 is a schematic illustration which shows an internal structure of the pressure limiter of FIG. 2.
Figure 2:
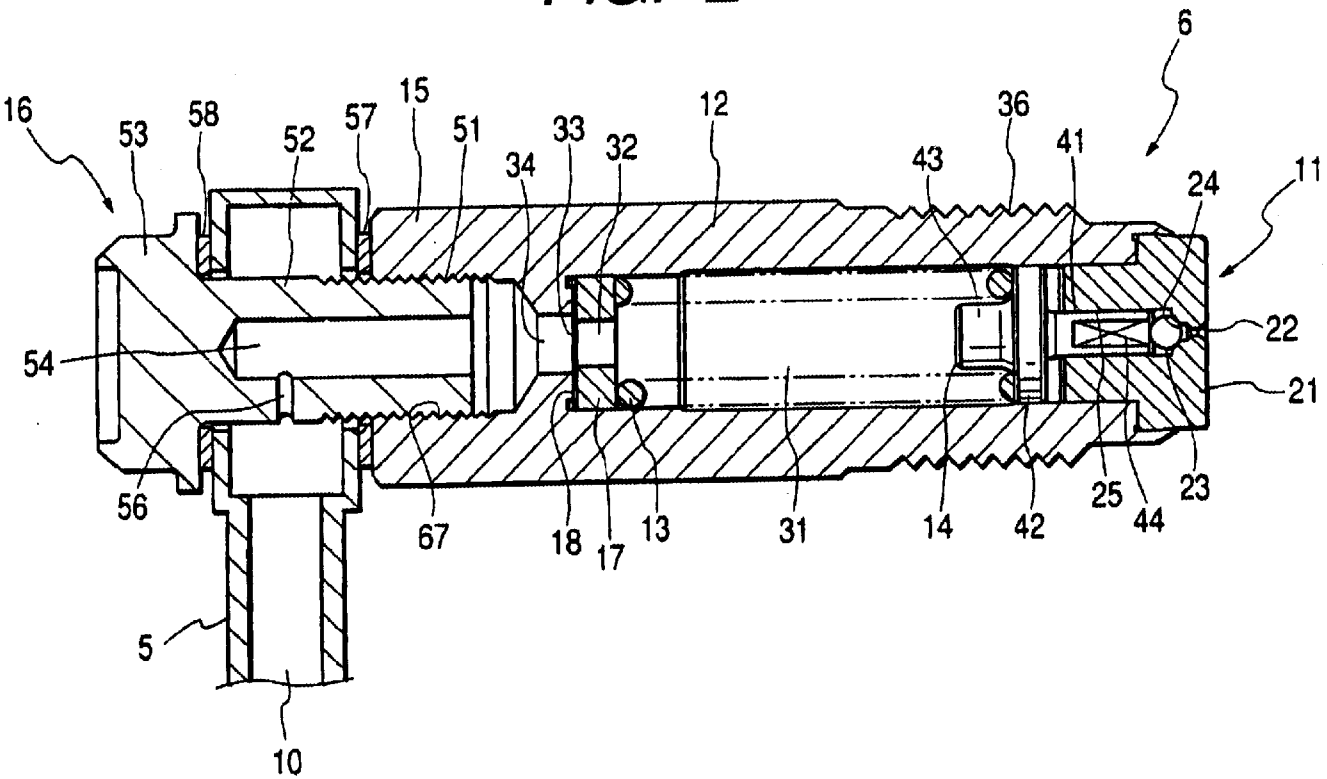
FIG. 2 is a sectional view which shows a pressure limiter according to the first embodiment of the invention which is designed to relieve a rise in fuel pressure within an accumulator.

The pressure limiter 6 consists, as shown in FIGS. 2 and 3, of a valve 11 connected to the accumulator of the common rail 3 in a liquid tight seal, a hollow cylindrical housing 12 joined to a downstream side of the valve 11 in a liquid tight seal, a spring 13 disposed within the housing 12, a spring guide 14 retaining an end of the spring 13, and a hollow screw 16 fitted in an opened end 15 (i.e., an outlet) of the housing 12.

The valve 11 is made up of a valve body 21 joined to an outlet pipe (not shown) of the common rail 3 in a liquid tight seal and a valve ball 23. The valve body 21 has formed in an end surface thereof a valve hole 22 communicating with the accumulator of the common rail 3 through the outlet pipe. The valve body 21 has formed therein a valve chamber within which the valve ball 23 is disposed for selectively opening and closing the valve hole 22. A valve seat 24 is formed on an inner wall of the valve chamber of the valve body 21. The valve ball 23 rests on the valve seat 24 to close the valve hole 22. The valve body 21 also has a sliding chamber 25 formed downstream of the valve chamber which supports the spring guide 14 slidably.

The housing 12 is made of a metallic hollow cylinder and has fitted therein annular shims 17 and 18 for achieving fine adjustment of a valve-opening pressure. The housing 12 defines therein an inlet side fuel hole 31, a fuel hole 34 smaller in diameter than the inlet side fuel hole 31, and an outlet side fuel hole 35. The shims 17 and 18 have fuel holes 32 and 33 formed therein, respectively, which are smaller in diameter than the inlet side fuel hole 31. The housing 12 has formed in an outer surface of an end thereof an external thread 36 which is fitted in a limiter mount (not shown) of the common rail 3. The housing 12 also has an internal thread 67 formed in the outlet side fuel hole 35 with which the hollow screw 16 engages.

The spring 13 is a coil spring disposed within the inlet side fuel hole 31 of the housing 12 to produce a set load urging the valve ball 23 into constant engagement with the valve seat 24 to close the valve hole 22 of the valve body 21. The spring 13 is retained at an end thereof on a rear end surface of a large-diameter portion 42 of the spring guide 14 and at the other end on a front surface of the shim 17. The seat diameter of the valve ball 23 (i.e., a contact area between the valve body 21 and the valve ball 23) and the set load of the spring 13 defines the valve-opening pressure acting on the valve ball 23 at which the valve hole 22 of the pressure limiter 6 is to be opened when the fuel pressure within the common rail 3 exceeds a specified limit. Fine adjustment of the valve-opening pressure may be accomplished by changing the thickness of the shim 17 and/or the shim 18.

The spring guide 14 is disposed within the inlet side fuel hole 31 of the housing 12 and the sliding chamber 25 of the valve body 21. The spring guide 14 is made up of a small-diameter portion 41 working as a cylindrical slider, the large-diameter portion 42, and a small-diameter portion 43 working as a spring-retaining boss. The small-diameter portion 41 is fitted to be slidable within the sliding chamber 25 of the valve body 21. The large-diameter portion 42 is fitted to be slidable within the inlet side fuel hole 31. The small-diameter portion 43 projects from the large-diameter portion 42 opposite the small-diameter portion 41.

The small-diameter portion 41 of the spring guide 14 has formed on an outer peripheral surface thereof two flat areas 44 which define fuel passages between themselves and an inner wall of the sliding chamber 25 of the valve body 21 which establish fluid communications between the inlet side fuel hole 31 and the valve hole 22 when the valve ball 23 and the spring guide 14 are moved away from the valve seat 24 over a preselected distance. The flat areas 44 are formed by grinding diametrically opposed portions of the outer peripheral surface of the small-diameter portion 41. The large-diameter portion 42 is disposed within the housing 12 and defines an annular gap between the outer periphery of the large-diameter portion 42 and the inner wall of the inlet side fuel hole 31 which serves as a fuel passage communicating with the valve hole 22.

The hollow screw 16 functions to absorb pulsation of fuel pressure and is installed downstream of the valve 11 and the outlet side fuel hole 35 of the housing 12. The hollow screw 16 closes the open end 15 of the housing 12 and consists of a sleeve 52 and a flanged head 53. The sleeve 52 has formed therein an external thread 51 engaging the internal thread 67 of the housing 12. The head 53 which is hexagonal and greater in diameter than the sleeve 52 is formed on an end of the sleeve 52.

The sleeve 52 has a longitudinal chamber 54 and an orifice 56 formed therein. The chamber 54 extends along a longitudinal center line of the sleeve 52 and communicates with the outlet side fuel hole 35 of the housing 12. The orifice 56 extends perpendicular to the chamber 54 and establishes fluid communication between the chamber 54 and the fuel passage 10 of the low-pressure pipe 5. The orifice 56 is smaller in diameter (i.e., a fuel flow sectional area) than the inlet side fuel hole 31, the fuel hole 34, the outlet side fuel hole 35, and the chamber 54 and works to absorb the pulsation of fuel pressure transmitted from a pulsation source to the valve 11 and the spring guide 14. Seal washers 57 and 58 are installed between the end of the housing 12 and the low-pressure pipe 5 and between the screw head 53 and the low-pressure pipe 5, respectively, to seal gaps formed among the sleeve 52, the low-pressure pipe 5, and the housing 12.

In operation, when the fuel pressure in the accumulator of the common rail 3 exceeds the valve-opening pressure of the pressure limiter 6, it will cause the valve ball 23 to be moved out of engagement with the valve seat 24 of the valve body 24 against the spring pressure produced by the spring 13, so that the valve hole 22 is opened. This causes the fuel stored within the common rail 3 to flow from the valve hole 22 to the orifice 56 through the sliding chamber 25, the inlet side fuel hole 31, the fuel hole 34, the outlet side fuel hole 35 of the housing 12, and the longitudinal chamber 35 of the hollow screw 16 and back to the fuel tank 1 through the fuel passage 10 of the low-pressure pipe 5. Specifically, the pressure limiter 6 works to relieve an excess pressure of the fuel stored in the accumulator of the common rail 3, thereby keeping the fuel pressure within the common rail 3 at a desired level.

Usually, when the fuel is discharged from the supply pump 2 or the injectors 4 and returned back to the fuel tank 1 through the low-pressure pipe 5, pressure pulsations are generated which may be propagated to the hollow screw 16 of the pressure limiter 6. If the pressure pulsations are transmitted to the spring guide 14 or the valve 11 of the pressure limiter 6, it will cause the valve ball 23 to bound in the valve body 21, which may result in an undesirable change in valve-opening pressure of the pressure limiter 6. The pressure limiter 6 of this embodiment, however, has the orifice 56 formed between the valve 11 and the low-pressure pipe 5 which works to absorb or block the transmission of the pressure pulsations from the low-pressure pipe 5 to the spring guide 14 and the valve 11, thereby avoiding the undesirable change in valve-opening pressure of the pressure limiter 6.

The orifice 56 is formed in the sleeve 52 of the hollow screw 16, but may alternatively be provided in an end portion of the fuel passage 10 of the low-pressure pipe 5 connecting with the hollow screw 16 or the housing 12. The orifice 56 may also be formed in the sleeve 52 longitudinally.

Figure 5:
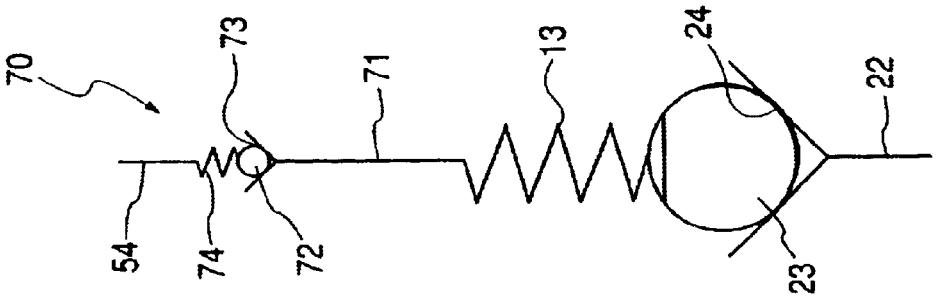
FIG. 5 is a schematic illustration which shows an internal structure of the pressure limiter of FIG. 4.
Figure 4:
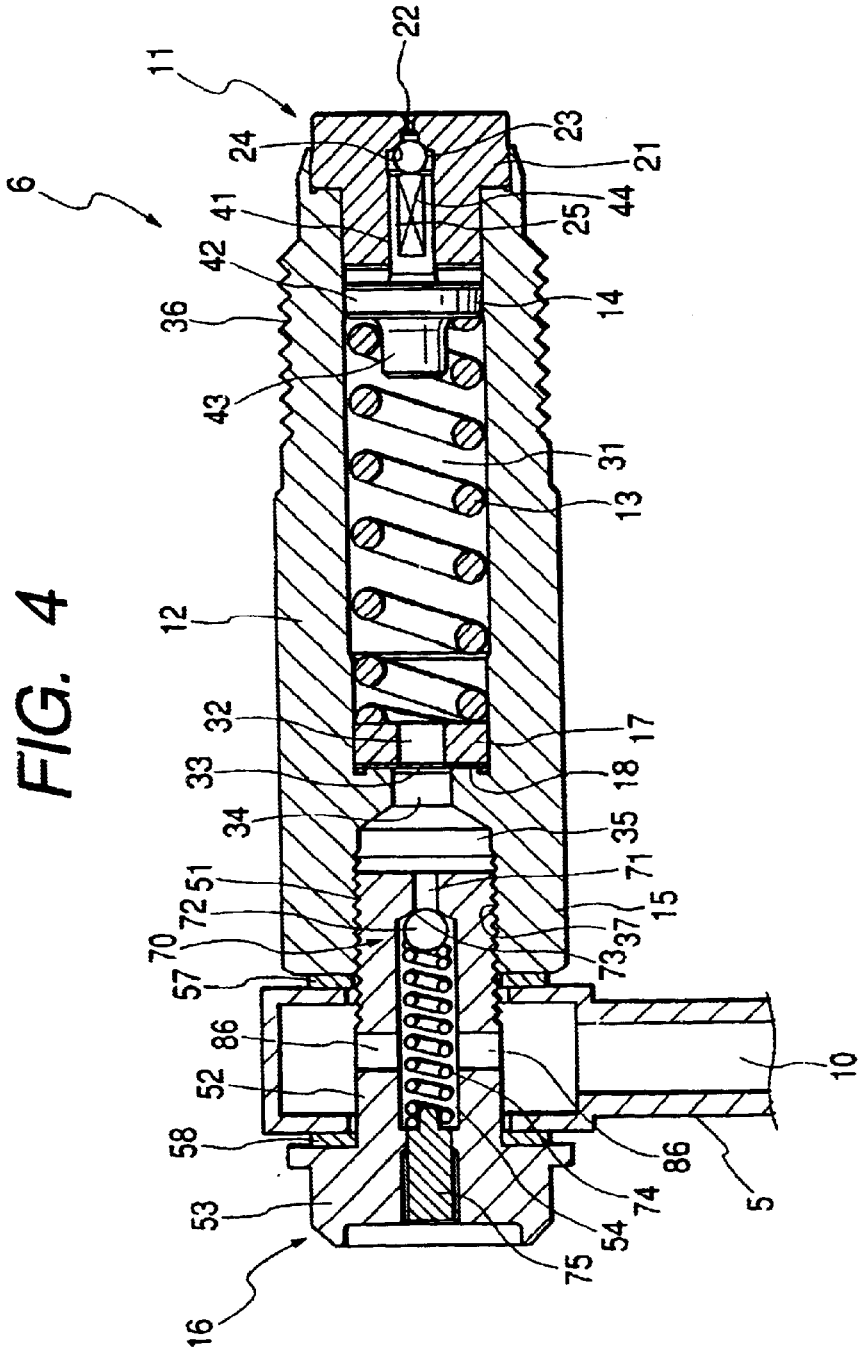
FIG. 4 is a sectional view which shows a pressure limiter according to the second embodiment of the invention.

FIGS. 4 and 5 show a pressure limiter 6 according to the second embodiment of the invention. The same reference numbers as employed in the first embodiment will refer to the same parts, and explanation thereof in detail will be omitted here.

The hollow screw 16, like the first embodiment, consists of the sleeve 52 and the screw head 53. The sleeve 52 has formed therein the longitudinal chamber 54 within which a check valve 70 is disposed for blocking transmission of pressure pulsations from the fuel passage 10 of the low-pressure pipe 5 to the spring guide 14 and the valve 11. The check valve 70 consists of an orifice 71, a ball 72, and a coil spring 74. The orifice 71 is formed in the end of the sleeve 52 and establishes fluid communication between the inlet side fuel hole 31 and the fuel passage 10 of the low-pressure pipe 5. The orifice 71 is smaller in diameter than the inlet side fuel hole 31, the fuel hole 34, the outlet side fuel hole 35, and the longitudinal chamber 54. The spring 74 is disposed within the longitudinal chamber 54 and urges the ball 72 into constant engagement with a valve seat 73 formed on an inner wall of the sleeve 52 to close the orifice 71.

The hollow screw 16 also includes an adjustor screw 75 which is fitted in a threaded hole formed in an end of the bolt head 53 in alignment with the spring 74 and works to adjust the pressure produced by the spring 74 which defines a valve-opening pressure at which the ball 72 is to be moved away from the valve seat 73 to open the orifice 71. The sleeve 52 also has formed therein a radial hole 86 which traverses the longitudinal chamber 54 to establish fluid communication between the fuel passage 10 and the longitudinal chamber 54.

In operation, when the fuel pressure in the accumulator of the common rail 3 exceeds the valve-opening pressure of the pressure limiter 6, it will cause the valve ball 23 to be moved out of engagement with the valve seat 24 of the valve body 24 against the spring pressure produced by the spring 13, so that the valve hole 22 is opened. This causes the fuel stored within the common rail 3 to flow from the valve hole 22 to the outlet side fuel hole 35 through the sliding chamber 25, the inlet side fuel hole 31, and the fuel hole 34. When the fuel pressure in the outlet side fuel hole 35 exceeds the valve-opening pressure of the check valve 70 set by the spring 74, it will cause the ball 72 to be moved away from the valve seat 73 against the valve-opening pressure, thereby opening the orifice 71. The fuel within the outlets side fuel hole 35, thus, flows into the longitudinal chamber 54 of the hollow screw 16 and is discharged to the fuel passage 10 from the radial hole 86, thereby keeping the fuel pressure within the common rail 3 at a desired level.

When pressure pulsations are generated in the low-pressure pipe 5 and enter the pressure limiter 6, the check valve 70 works to block the propagation of the pressure pulsations to the spring guide 14 and the valve 11, thereby avoiding, like the first embodiment, an undesirable change in valve-opening pressure of the pressure limiter 6.

The pressure limiter 6 in each of the first and second embodiments may also be used with a common rail fuel injection system in which the fuel stored in a common rail is injected to a diesel engine using a single fuel injector. In this case, instead of the common rail 3, a high-pressure pipe working as an accumulator may alternatively be installed between the supply pump 2 and the injector.

The supply pump 2 used in the above embodiments is a distributor type pump designed to distribute fuel to a plurality of cylinders of the engine using a single or two pairs of plungers or less, but may alternatively be implemented by an in-line pump which has as many plungers as the cylinders of the engine and supplies the pressurized fuel through each of the plungers every turn of a cam shaft.

The valve ball 23 and the spring guide 14 may alternatively be made of a one-piece member. The housing 12 and the valve body 21 may also be of one-piece construction. Instead of the spring 13, an air cushion, a rubber, or an elastic plate may alternatively be used to urge the valve ball 23 into constant engagement with the valve seat 24 through the spring guide 14.

The check valve 70 is installed in the sleeve 52 of the hollow screw 16, but may alternatively be provided in an end portion of the fuel passage 10 of the low-pressure pipe 5 connecting with the hollow screw 16 or the housing 12.

Figure 6:
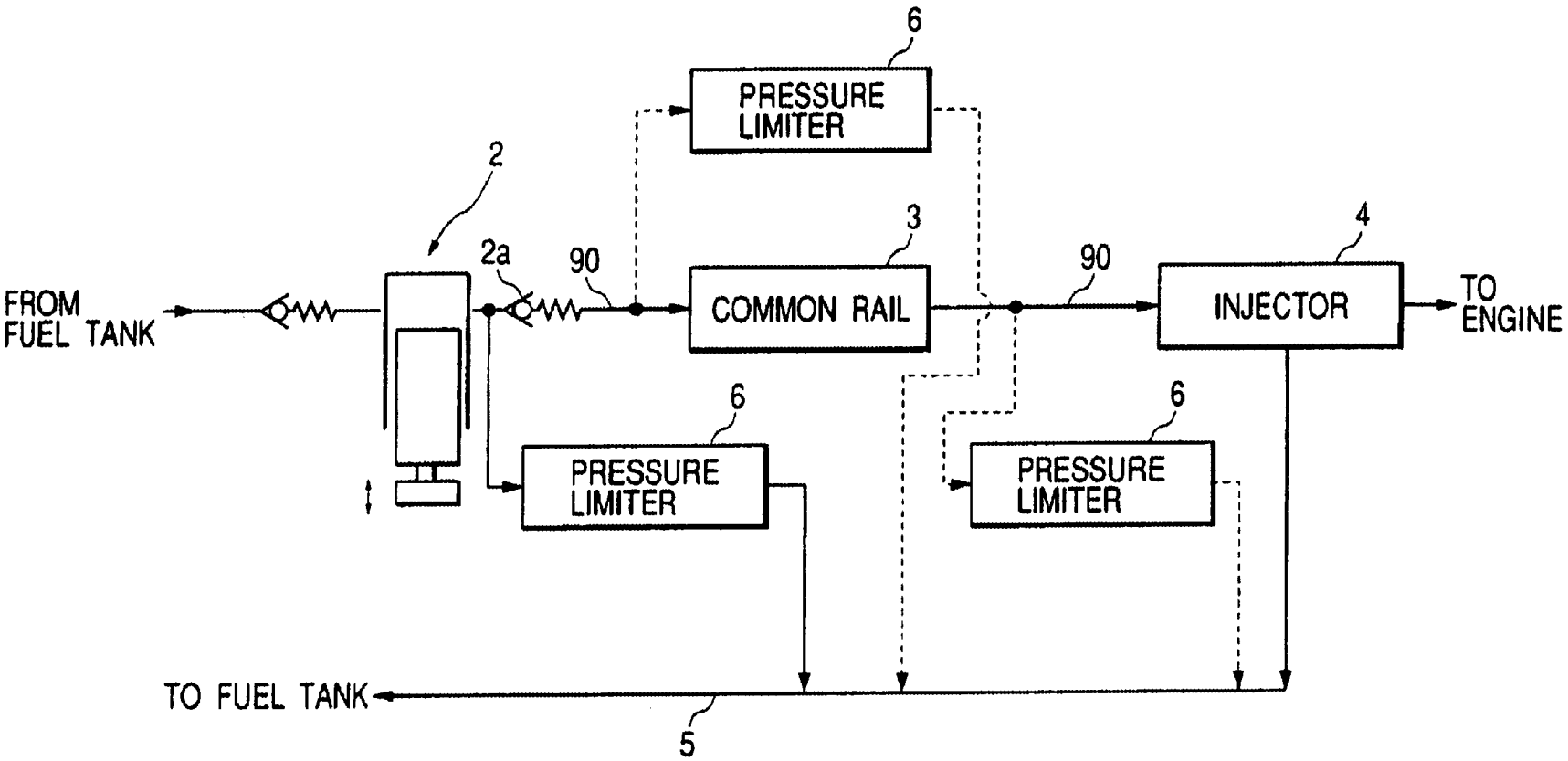
FIG. 6 is a block diagram which shows modifications of a pressure limiter.
Figure 7:
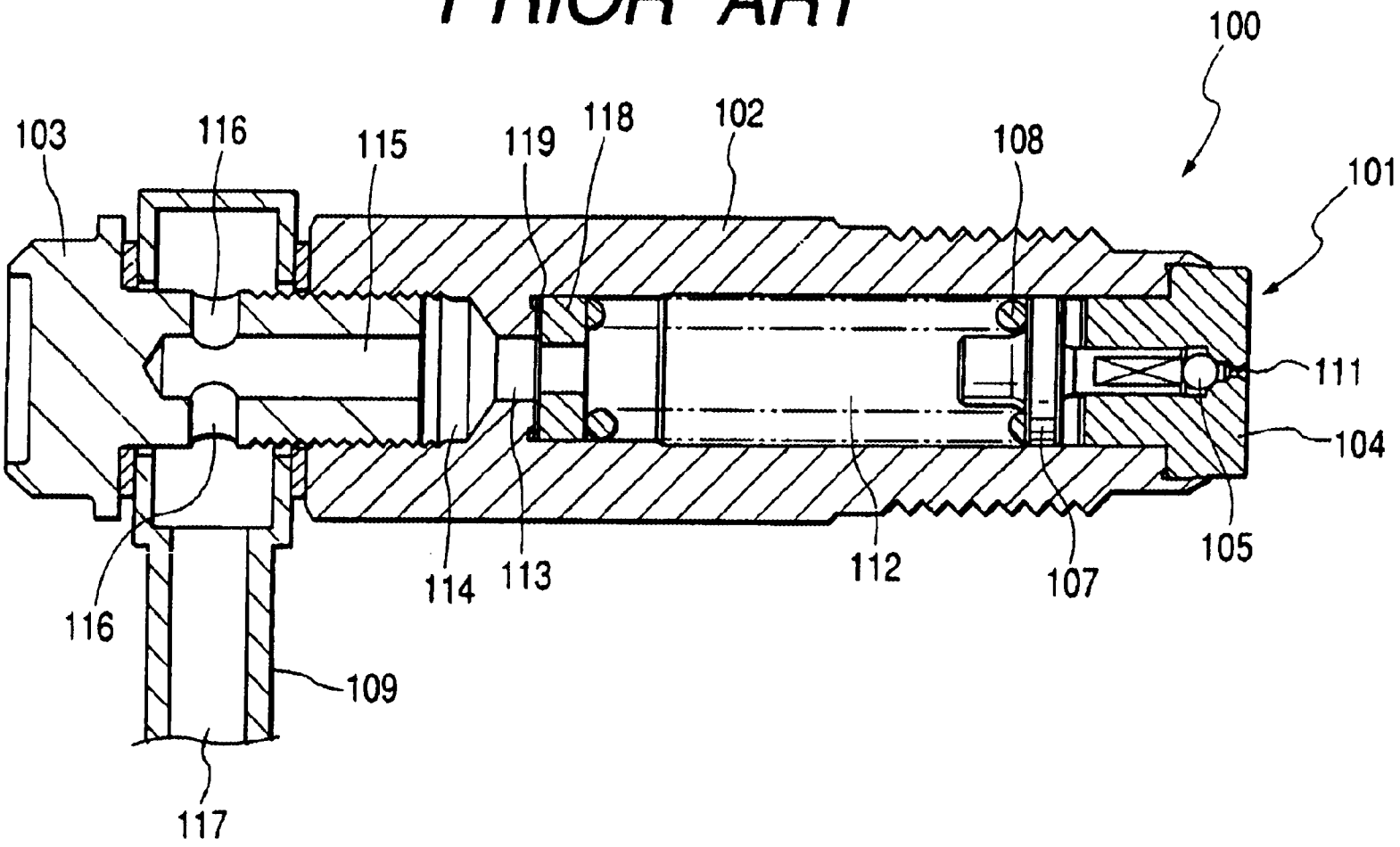
FIG. 7 PRIOR ART
FIG. 7 is a sectional view which shows a conventional pressure limiter installed in typical accumulator fuel injection systems.

The pressure limiter 6 in each of the first and second embodiments is joined directly to the accumulator in the common rail 3, but however, may alternatively be installed, as shown in FIG. 6, between an outlet of the supply pump 2 and the low-pressure pipe 5. In this case, the inlet (i.e., the valve hole 22) of the pressure limiter may be connected to a downstream side of a check valve 2*a* of the supply pump 2 or an upstream side of the check valve 2*a*, as indicated by a broken line, to keep the pressure of the fuel flowing into the common rail 3 at a desired level. Further, the pressure limiter 6 may alternatively be installed, as indicated by a broken line on the right side of the drawing, between a portion of a high-pressure fuel line 90 between the outlet of the common rail 3 and the inlet of the fuel injector 4 to keep the pressure of the fuel supplied to the fuel injector 4 at a desired level.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. An accumulator fuel injection apparatus comprising:

a high-pressure supply pump pumping fuel out of a fuel tank, said high-pressure supply pump pressuring and discharging the fuel;

an accumulator storing therein the fuel discharged from said high-pressure supply pump;

a fuel injector injecting the fuel stored in said accumulator into an internal combustion engine;

a high-pressure fuel line extending from said high-pressure supply pump to said fuel injector through said accumulator;

a relief valve having an inlet communicating with said high-pressure fuel line, an outlet, and a valve mechanism disposed between the inlet and the outlet, the valve mechanism being responsive to a rise in pressure of the fuel within said high-pressure fuel line beyond a given level to establish communication between the inlet and the outlet for relieving the rise in pressure of the fuel within said high-pressure fuel line; and a pressure pulsation absorbing mechanism disposed between the valve mechanism of said relief valve and a pressure pulsation source existing downstream of the outlet of paid relief valve, said pressure pulsation absorbing mechanism working to absorb a pressure pulsation propagated from the pressure pulsation source to the valve mechanism of said relief valve;

wherein said valve mechanism includes a valve body in which the inlet of said relief valve is formed and a valve member movable to open and close the inlet selectively, wherein said relief valve includes a hollow cylindrical housing having a fuel hole formed between the inlet and the outlet, wherein said pressure pulsation absorbing mechanism includes a hollow screw which is fitted in an open end of the housing as defining the outlet of said relief valve and has formed therein an orifice working to absorb the pressure pulsation to be propagated from the pressure pulsation source to the valve mechanism, and further comprising a valve-urging mechanism disposed in the fuel hole of the housing which urges the valve member to close the inlet constantly;

said hollow screw includes a sleeve and a flange head, the sleeve being retained within the open end of the housing and having formed therein a longitudinal chamber communicating with the fuel hole of the housing through an end of the sleeve, the flange head being formed on an end of the sleeve opposite the housing; and said orifice is implemented by a hole formed in the sleeve which extends perpendicular to the longitudinal chamber of the sleeve, the hole being smaller in diameter than the fuel hole of the housing and the longitudinal chamber of the sleeve.

2. An accumulator fuel injection apparatus as set forth in claim 1, wherein said relief valve communicates at the inlet thereof with said accumulator for relieving a rise in pressure of the fuel within said accumulator beyond the given level to keep the pressure in said accumulator constant.

3. An accumulator fuel injection apparatus as set forth in claim 1, wherein said relief valve communicates at the inlet thereof with an outlet of said high-pressure supply pump for relieving a rise in pressure of the fuel flowing into said accumulator beyond the given level to keep the pressure of the fuel supplied to said accumulator constant.

4. An accumulator fuel injection apparatus as set forth in claim 1, wherein said relief valve communicates at the inlet thereof with a portion of said high-pressure fuel line extending from said accumulator to said fuel injector for relieving a rise in pressure of the fuel supplied to said fuel injector beyond the given level to keep the pressure of the fuel supplied to said fuel injector constant.

5. An accumulator fuel injection apparatus comprising:

a high-pressure supply pump pumping fuel out of a fuel tank, said high-pressure supply pump pressuring and discharging the fuel;

an accumulator storing therein the fuel discharged from said high-pressure supply pump;

a fuel injector injecting the fuel stored in said common rail into an internal combustion engine;

a relief valve having an inlet communicating with said high-pressure fuel line, an outlet, and a valve mechanism disposed between the inlet and the outlet, the valve mechanism being responsive to a rise in pressure of the fuel within said high-pressure fuel line beyond a given level to establish communication between the inlet and the outlet for relieving the rise in pressure of the fuel within said high-pressure fuel line; and a check valve disposed between the valve mechanism of said relief valve and a pressure pulsation source existing downstream of the outlet of said relief valve, said check valve working to block transmission of a pressure pulsation from the pressure pulsation source to the valve mechanism of said relief valve.

6. An accumulator fuel injection apparatus as set forth in claim 5, wherein said valve mechanism includes a valve body in which the inlet of said relief valve is formed and a valve member movable to open and close the inlet selectively, wherein said relief valve includes a hollow cylindrical housing having a fuel hole formed between the inlet and the outlet, further comprising a hollow screw which is fitted in an open end of the housing as defining the outlet of said relief valve and has disposed therein said check valve and further comprising a valve-urging mechanism disposed in the fuel hole of the housing which urges the valve member to close the inlet constantly.

7. An accumulator fuel injection apparatus as set forth in claim 6, wherein said check valve includes a valve body, a check valve member, and a check valve-urging mechanism, the valve body having an orifice formed downstream of the fuel hole of the housing of said relief valve in communication therewith, the check valve-urging mechanism urging the check valve member into constant engagement with the orifice of the valve body.

8. An accumulator fuel injection apparatus as set forth in claim 5, wherein said relief valve communicates at the inlet thereof with said accumulator for relieving a rise in pressure of the fuel within said accumulator beyond the given level to keep the pressure in said accumulator constant.

9. An accumulator fuel injection apparatus as set forth in claim 5, wherein said relief valve communicates at the inlet thereof with an outlet of said high-pressure supply pump for relieving a rise in pressure of the fuel flowing into said accumulator beyond the given level to keep the pressure of the fuel supplied to said accumulator constant.

10. An accumulator fuel injection apparatus as set forth in claim 5, wherein said relief valve communicates at the inlet thereof with a portion of said high-pressure fuel line extending from said accumulator to said fuel injector for relieving a rise in pressure of the fuel supplied to said fuel injector beyond the given level to keep the pressure of the fuel supplied to said fuel injector constant.

11. An accumulator fuel injection apparatus comprising:

a high-pressure supply pump pumping fuel out of a fuel tank, said high-pressure supply pump pressuring and discharging the fuel;

an accumulator storing therein the fuel discharged from said high-pressure supply pump;

a fuel injector injecting the fuel stored in said accumulator into an internal combustion engine;

a high-pressure fuel line extending from said high-pressure supply pump to said fuel injector through said accumulator;

a relief valve having an inlet communicating with said high-pressure fuel line, an outlet, and a valve mechanism disposed between the inlet and the outlet, the valve mechanism being responsive to a rise in pressure of the fuel within said high-pressure fuel line beyond a given level to establish communication between the inlet and the outlet for relieving the rise in pressure of the fuel within said high-pressure fuel line, said valve mechanism including a valve body in which the inlet of said relief valve is formed and a valve member movable to open and close the inlet selectively, said relief valve including a hollow cylindrical housing having a fuel hole formed between the inlet and the outlet; and a pressure pulsation absorbing mechanism disposed between the valve mechanism of said relief valve and a pressure pulsation source existing downstream of the outlet of said relief valve, said pressure pulsation absorbing mechanism working to absorb a pressure pulsation propagated from the pressure pulsation source to the valve mechanism of said relief valve, said pressure pulsation absorbing mechanism including a hollow screw which is fitted in an open end of the housing as defining the outlet of said relief valve and has formed therein an orifice working to absorb the pressure pulsation to be propagated from the pressure pulsation source to the valve mechanism, said hollow screw including a sleeve, the sleeve being retained within the open end of the housing and having formed therein a longitudinal chamber communicating with the fuel hole of the housing through an end of the sleeve; and a valve-urging mechanism disposed in the fuel hole of the housing which urges the valve member to close the inlet constantly;

wherein said orifice is implemented by a hole formed in the sleeve which extends perpendicular to the longitudinal chamber of the sleeve, the hole being smaller in diameter than the fuel hole of the housing and the longitudinal chamber of the sleeve.

* * * * *